US005398575A

United States Patent [19]

Rewitzer

[11] Patent Number: 5,398,575

[45] Date of Patent: Mar. 21, 1995

[54] APPARATUS FOR CONTINUOUSLY CUTTING UP MATERIAL IN SLIVER OR STRAND FORM

[75] Inventor: Siegfried Rewitzer, Ihrlerstein, Germany

[73] Assignee: Hoechst Aktiengesellschaft, Germany

[21] Appl. No.: 13,626

[22] Filed: Feb. 4, 1993

[30] Foreign Application Priority Data

Feb. 8, 1992 [DE] Germany ..... 42 03 640.2

[51] Int. Cl.[6] ..... D01G 1/04; B26D 1/62

[52] U.S. Cl. ..... 83/72; 83/346; 83/348; 83/913

[58] Field of Search ..... 83/913, 62.1, 522.15, 83/522.23, 522.27, 72, 346, 348, 566, 582, 591, 543, 913

[56] References Cited

U.S. PATENT DOCUMENTS

| | | | |
|---|---|---|---|
| 3,687,069 | 8/1972 | Helrigel et al. | 83/522.23 X |
| 3,744,361 | 7/1973 | Van Doorn et al. | 83/913 X |
| 3,826,163 | 7/1974 | Spaller, Jr. et al. | 83/913 X |
| 4,548,106 | 10/1985 | Fleissner . | |
| 4,569,264 | 2/1986 | Van Doorn et al. . | |
| 4,771,665 | 9/1988 | Van Doorn et al. . | |
| 4,785,548 | 11/1988 | Saleh | 83/913 X |
| 4,971,021 | 11/1990 | Kubotera et al. | 83/522.15 X |

FOREIGN PATENT DOCUMENTS

| | | |
|---|---|---|
| 0305057 | 3/1989 | European Pat. Off. . |
| 2720918 | 3/1980 | Germany . |
| 3311190 | 9/1984 | Germany . |
| 1345425 | 1/1974 | United Kingdom . |

*Primary Examiner*—Rinaldi I. Rada
*Attorney, Agent, or Firm*—Connolly & Hutz

[57] ABSTRACT

The apparatus according to the invention comprises a cutting wheel (1) provided with a multiplicity of cutting knives (3) disposed in a circle in a knife mount (2) and spaced apart at predetermined distances corresponding to the desired staple, at least one pressure roller (4) for producing on the wound material in sliver or strand form a cutting pressure acting on the cutting knives (3), an opening and closing device (5) by means of which the pressure roller (4) can be moved a predetermined distance away from the cutting wheel (1) or towards the cutting wheel (21), an adjusting member (6) by which a preset distance can be adjusted between the pressure roller (4) and the cutting knife (3) lying nearest to said pressure roller (4), a damping means (7) by which, in conjunction with the adjusting means (6), the contact pressure exerted by the pressure roller (4) on the material in sliver or strand form lying on the knives (3) can be so adjusted that the cutting power of the apparatus remains practically unchanged within a preset contact pressure range, and a distance measuring device (8) by which the distance between the pressure roller (4) and the cutting knife (3) situated closest to the pressure roller (4) can be monitored.

17 Claims, 6 Drawing Sheets

APPARATUS FOR CONTINUOUSLY CUTTING UP MATERIAL IN SLIVER OR STRAND FORM

The present invention relates to an improved apparatus for continuously cutting up material in sliver or strand form, particularly man-made fiber tows, and to an improved method of cutting up such material in sliver or strand form.

Methods and apparatuses for continuously cutting up material in sliver or strand form are known per se.

From EP-A-305,057 a cutting apparatus for fiber tows is known. This apparatus contains a knife basket, equipped with cutting knives, and a pressure roller which presses the fibers against the cutting knives. This apparatus is characterized in that it contains a means enabling the angular position of the cutting wheel in relation to the pressure roller to be determined, in that it contains a means enabling the contact pressure exerted by the pressure roller on the cutting knives to be determined, and in that it contains a means enabling the quality of the cutting knives to be determined in dependence on the angular position of the cutting wheel and the pressure exerted on the cutting knives. With the known apparatus it is therefore possible to monitor the quality of the cutting knives during operation, and thus to monitor the quality of the cut material.

In DE-A-3,311,190 an apparatus for cutting up material in sliver or strand form is described, which comprises a knife basket having two knife support disks disposed axially one above the other with spacing approximately equal to a knife length, between which disks a multiplicity of knives directed radially outwards with spacing corresponding to the desired staple are mounted, while at least one pressure roller is associated with the knife basket outside and spaced apart to obtain a cutting pressure acting radially inwards on the wound fiber tow. The known apparatus is characterized in that more than only one pressure roller is associated with a knife basket. With the previously known device a high yield of cut material can be obtained without causing heavier loading of the cutting knives.

From DE-AS-2,720,918 a method and an apparatus for monitoring the cutting in a staple fiber cutting machine are known, in which the cutting capacity of each individual cutting blade is determined and at pressures which are too high or too low a signal is produced which can be used to stop the staple fiber cutting machine. The apparatus described contains two measuring elements by means of which the position of the cutting knives and the deflection of a pressure roller are determined. Planned control of the pressure force during the cutting operation is not proposed.

In addition, from DE-AS-2,144,104 a method and an apparatus for cutting up spinning tows are known, in which a spring force is applied in order to press a pressure roller against the spinning tow, the pressure roller being moved against the pressure of the spring during the cutting operation and the apparatus being switched off when a maximum permissible limit value of the pressure force is reached. Planned monitoring of the distance between the cutting knife and the pressure roller and readjustment of this distance during the cutting operation cannot be seen in this publication.

During the operation of these previously known apparatuses it has however been found that in the continuous cutting of material in sliver or strand form problems may arise which cannot be completely satisfactorily solved with these apparatuses. Thus, for example, the cutting power of the apparatus and the quality of the cut material may vary during continuous operation as the result of wear on the knife edges. In individual cases it may also be necessary to adapt the pressure force to the properties of the material to be cut up, such as the type of fiber, preparation or dampness; it would therefore be desirable to be able to adapt the pressure applied by the pressure roller in a simple manner to changing cutting conditions. In addition, it happens during continuous cutting operations that the material to be cut may have flaws, such as knots or thickenings. Such flaws can lead to a load on the cutting knives for a longer or shorter period of time, and in certain cases knives may be broken. Such knife breakages may have the consequence that the knives fall out of their mounts and that no cutting will take place at the point concerned, with the result that excessively long fibers will be produced. In addition, the wound material may heap up on the cutting apparatus during continuous operation after a knife breakage when the knife does not fall out of its mount.

Furthermore, during the operation of such apparatuses, particularly in the production of short cut fibers, it must be borne in mind that, in addition to the cutting pressure, the pressure rollers must apply further pressure by which the cut staple is carried along the knives into the interior of the cutting wheel. At the beginning of the cutting operation, with sharp knives, the proportion of the pressure applied for the actual cutting operation is relatively low in comparison with the proportion of the pressure required for carrying the cut staple along the knives. In the course of the cutting operation the knives become blunt, and the proportion of the pressure required for cutting may amount to a multiple of the proportion of the pressure required for carrying the cut staple along the knives. In practice, consequently, these known apparatuses are expediently operated in such a manner that at the beginning of the cutting operation the pressure rollers are brought so close to the cutting wheel that they lie on the relevant stop, and the contact pressure is set so high that the position of the pressure rollers remains practically unchanged throughout the entire cutting operation.

Taking as starting point the methods and apparatuses of the kind first mentioned above, the problem underlying the invention is that of making available an improved method and an improved apparatus with which it is possible, in a simple manner, to monitor the quality of the cutting knives, to maintain a constant quality of the cut material over the longest possible period of time, to lengthen the cutting life of the cutting knives, to adapt the cutting conditions in a simple manner to different materials, and to keep as slight as possible the problems due to the occurrence of flaws in the material being cut.

The invention is based on the realization that special advantages are gained in the cutting-up of material of this kind if the pressure roller is mounted in a pendulum suspension and in normal operation is situated at as constant as possible a distance from the cutting wheel. This constant distance is desirable because, if the distance should vary, the material already wound on the cutting wheel may be displaced at right angles to the cutting direction, so that transverse forces can occur which should as far as possible be avoided. The pendulum suspension is desirable because it permits a gentler cutting process, particularly with cutting apparatuses having a plurality of pressure rollers.

The apparatus according to the invention is in particular distinguished in that the force acting on the material being cut can be varied in a simple manner, in dependence on the quality of the knives, with the most constant distance possible between the knives and the pressure wheel, and in that means are provided with which, in the event of knife breakage or other irregularities, a fault signal is given to the operating staff, and/or the apparatus is stopped, in the simplest possible manner.

This problem is solved with an apparatus for continuously cutting up material in sliver or strand form, particularly man-made fiber tows, which comprises:

a) a cutting wheel (1) having a multiplicity of cutting knives (3) disposed in a circle in a knife mount (2) and spaced apart at predetermined distances corresponding to the desired staple, b) at least one pressure roller (4) for producing on the wound material in sliver or strand form a cutting pressure acting on the cutting knives (3), c) an opening and closing device (5) by means of which the pressure roller (4) can be moved a predetermined distance away from the cutting wheel (1) or towards the cutting wheel (1), d) an adjusting means (6) by which a preset distance can be adjusted between the pressure roller (4) and the cutting knife (3) lying nearest to said pressure roller (4), e) a damping means (7) by which, in conjunction with the adjusting means (6), the contact pressure exerted by the pressure roller (4) on the material in sliver or strand form lying on the knives (3) can be so adjusted that the cutting power of the apparatus remains practically unchanged within a preset contact pressure range, and f) a distance measuring device (8) by which the distance between the pressure roller (4) and the cutting knife (3) situated closest to the pressure roller (4) can be monitored.

The apparatuses according to the invention may contain the opening and closing device (5), the adjusting means (6) and the damping means (7) as respective separate components. These components may however also be partly or entirely grouped together in one component.

The cutting wheel (1) in the apparatus according to the invention may be constructed in any known form. Thus, the cutting edges of the knives may point in the direction of the axis of rotation of the cutting wheel. Cutting wheels of this type are for example disclosed in DE-A-2,720,918.

The knife basket of the apparatus according to the invention is preferably constructed as described in DE-A-3,311,190. The arrangement thus comprises a cutting wheel (1) composed of a knife basket (2) having two knife support disks disposed axially one above the other with spacing approximately equal to a knife length, between which disks a multiplicity of knives (3) directed radially outwards with spacing corresponding to the desired staple are mounted.

The pressure roller used for obtaining a cutting pressure, acting on the wound fiber tow in the direction of the cutting edges of the knives, may be devices customarily used for the purpose, such as are described for example in DE-A-3,311,190. It is possible to equip the apparatus according to the invention with only one pressure roller. However, a plurality of pressure rollers is also possible.

Any device suitable for the purpose may be used as the opening and closing device (5). Such devices are usually movement devices with the aid of which machine parts can be moved over larger distances in the centimeter or decimeter range for the resetting or maintenance of the cutting apparatus. Examples thereof are mechanically, hydraulically, pneumatically or electromechanically driven devices.

The apparatus according to the invention contains at least one, preferably one adjusting means (6) by which a preset distance can be adjusted between the pressure roller (4) and the cutting wheel (1). With the aid of this adjusting means (6) an initial state of the cutting apparatus is defined at the beginning of operation, and during operation this adjusting means serves to readjust the distance, which varies during operation, to the originally preset value. The adjusting means (6) may be any device suitable for this purpose. Use is generally made of movement devices with the aid of which machine parts can be moved over shorter distances in or below the millimeter range. As in the case of the opening and closing device, examples of these are correspondingly adapted mechanically, hydraulically, pneumatically or electromechanically driven devices.

Any device suitable for the purpose may be used as the damping means (7). The damping means (7) consists of an oscillatable mechanical system; the latter is characterized by a load-extension characteristic. This component may for example be a spring or a spring assembly, or else any other device with the aid of which a load-extension characteristic corresponding to a spring can be preset, for example a computer-controlled mechanical or electromechanical component with the aid of which a desired load-extension characteristic can be adjusted.

Springs or spring assemblies, for example spiral, leaf or cup springs, are preferably used as the damping means (7). These may be tension springs or in particular compression springs. It is very particularly preferred to use cup springs, since with their aid load-extension characteristics of the most diverse steepness can be obtained in a simple manner.

In addition to adjustment of the contact pressure on the material in sliver or strand form lying on the knives (3), the damping means also serves for the effective deadening of shocks from the pressure roller (4) caused when a flaw passes through the narrow gap between the cutting apparatus and the pressure roller.

Any device suitable for the purpose may be used as the distance measuring device (8) with the aid of which the distance between the pressure roller and the cutting apparatus can be monitored. With the aid of this distance measuring device (8) either a direct measurement may be made or, preferably, an indirect measurement is made which enables the distance to be deduced. Indirect measurement is preferred because the position of the distance measuring device in the cutting apparatus can in this case be freely selected.

The distance measuring device may for example be a line marking provided on any component which in the course of the operation of the cutting apparatus varies in length, said marking being compared with a stationary location, for example a location on the casing. It may however also be any other device suitable for this purpose. Examples thereof are moving coils, induction coils, displacement transducers, wire strain gauges, ultrasonic or laser beam distance measuring devices.

When more than one pressure roller is provided, it is generally sufficient to make only one distance measurement.

The apparatus according to the invention is preferably equipped with two pressure rollers, which in particular are disposed at an angle of about 120 to about 270 degrees to one another, referring to the diameter of the cutting wheel. It is very particularly preferred to provide two pressure rollers (2), which are disposed approximately opposite one another.

The contact pressure exerted on the material in sliver or strand form lying on the knives is applied mainly by the pressure roller. This contact pressure is adjusted on the commencement of operation by, among other factors, the choice of the preset distance between the pressure roller and the cutting apparatus. During the continuous cutting operation the material which is to be cut up is wound around or onto the knife basket and is carried through the narrow passage between the pressure roller and the cutting apparatus. A cutting force is thereby built up and the inner layer of the material to be cut up is cut up by the knife edges and carried away from the cutting wheel through the gaps between the knives. Because of wear on the knife edges during operation, the cutting speed decreases and the amount of material wound on the cutting apparatus increases. As a result, the distance between the pressure roller and the cutting apparatus is increased. The apparatus according to the invention provides a damping means, with the aid of which, in conjunction with the adjusting means, the contact pressure exerted by the pressure roller on the material in sliver or strand form lying on the knives can be adjusted, so that the cutting power of the apparatus remains practically unchanged within a prescribed contact pressure range.

The invention also relates to a method for continuously cutting up material in sliver or strand form, particularly man-made fiber tows, wherein the material to be cut up is brought to a cutting wheel (1), which comprises a multiplicity of cutting knives (3) which are disposed in a circle in a knife mount (2) and spaced apart at predetermined distances corresponding to the desired staple, and cut by a force acting in the direction between the material and the cutting edges of the cutting knives (3), for which purpose a package comprising winding layers lying one on the other is continuously formed from the material to be cut up, in such a manner that the new material coming to the knife roller forms in each case the winding layer lying farthest from the cutting edges in the package, and that the winding layer lying directly on the cutting edges is continuously cut up by the cutting edges of the cutting knives, while the force acting between the material and the cutting edges of the cutting knives (3) is mainly produced by means of a pressure roller (4) acting on the winding layer lying farthest from the cutting edges in the package, said method comprising the following steps:

i) Adjustment of a predetermined distance between the pressure roller (4) and the cutting edges of the cutting knives (3) with the aid of an adjusting means (6), while said distance is to be so selected that the pressure roller (4) can oscillate relative to the cutting wheel (1), ii) Monitoring said predetermined distance with the aid of a distance measuring device (8), and iii) Adjustment of the cutting pressure exerted by the pressure roller (4) on the material in sliver or strand form lying on the knives (3) with the aid of a damping means (7), which cooperates with the adjusting means (6), in such a manner that the cutting power of the apparatus remains practically unchanged within a prescribed range of contact pressures.

The apparatus according to the invention and the method according to the invention are described by way of example with reference to the following FIGS. 1 to 7.

Figure 3:
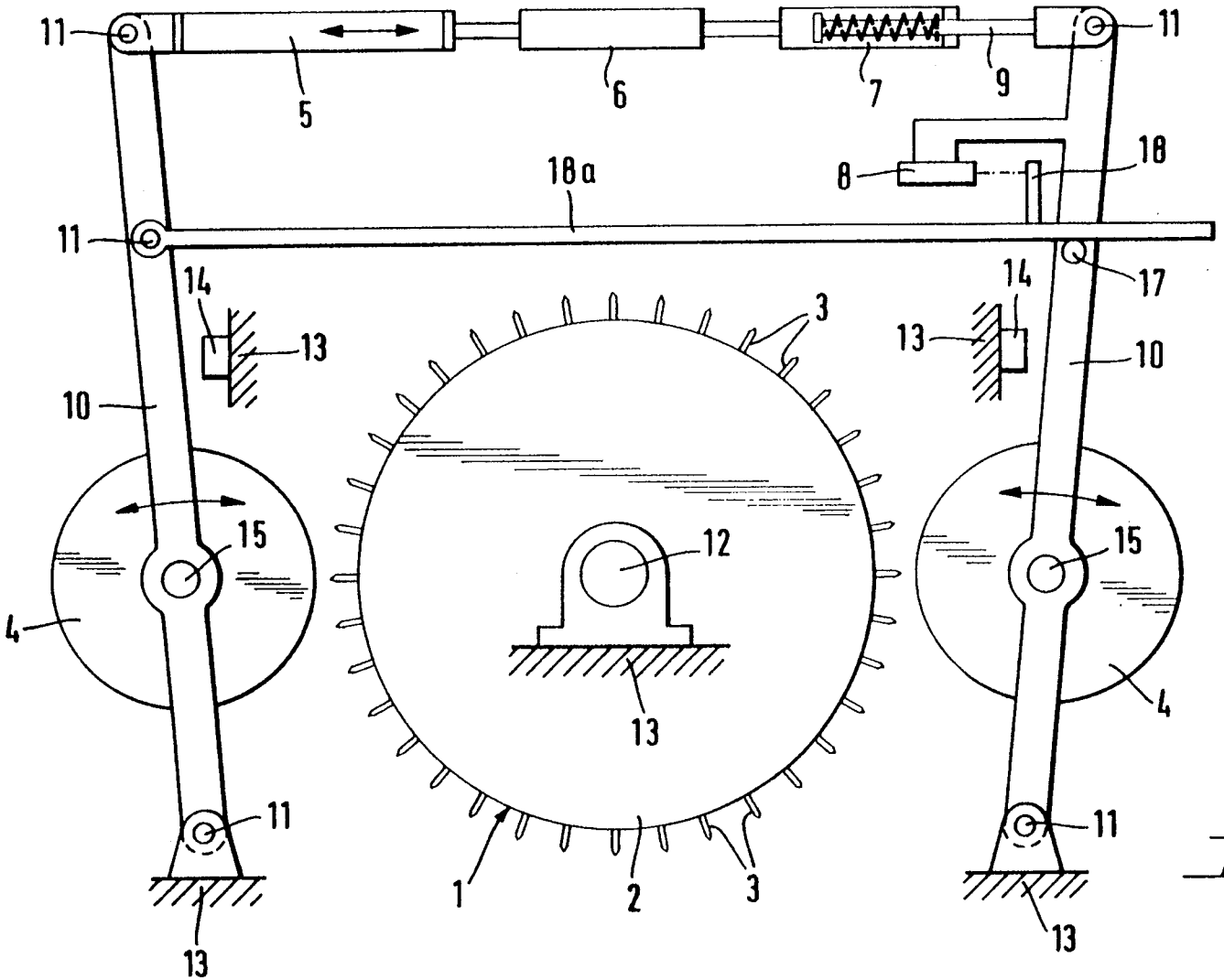
Figure 4:
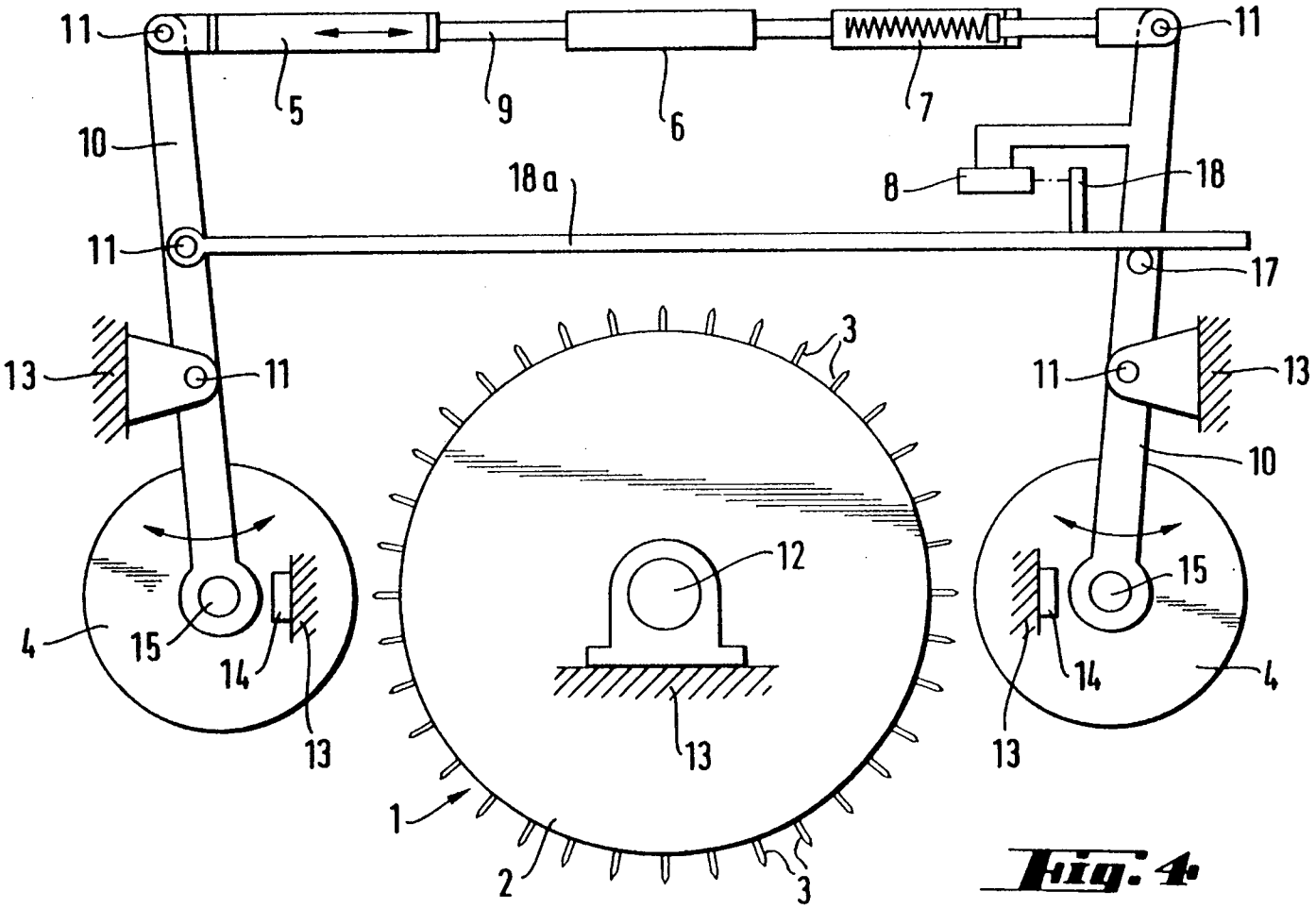
Figure 5:
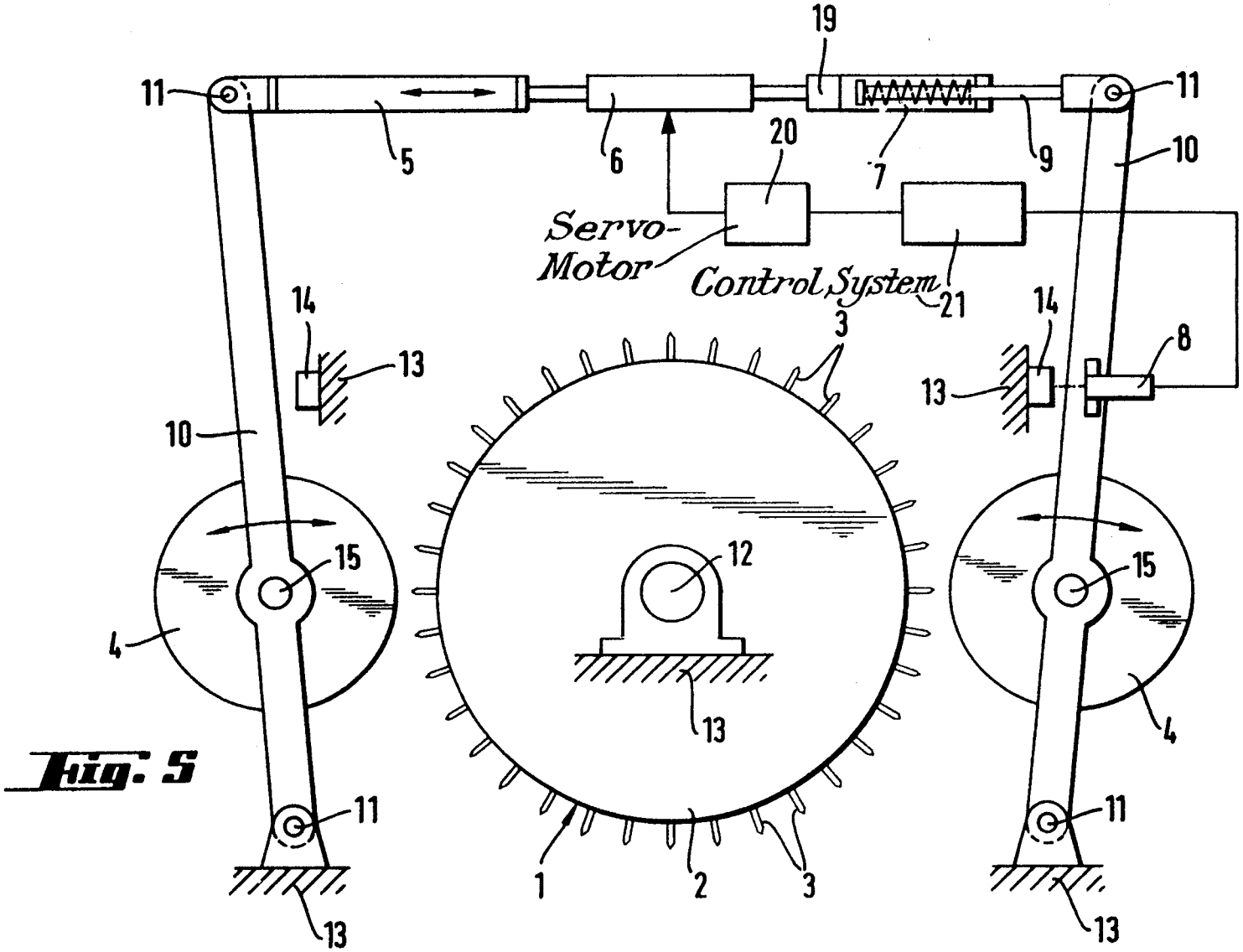
Figure 6:
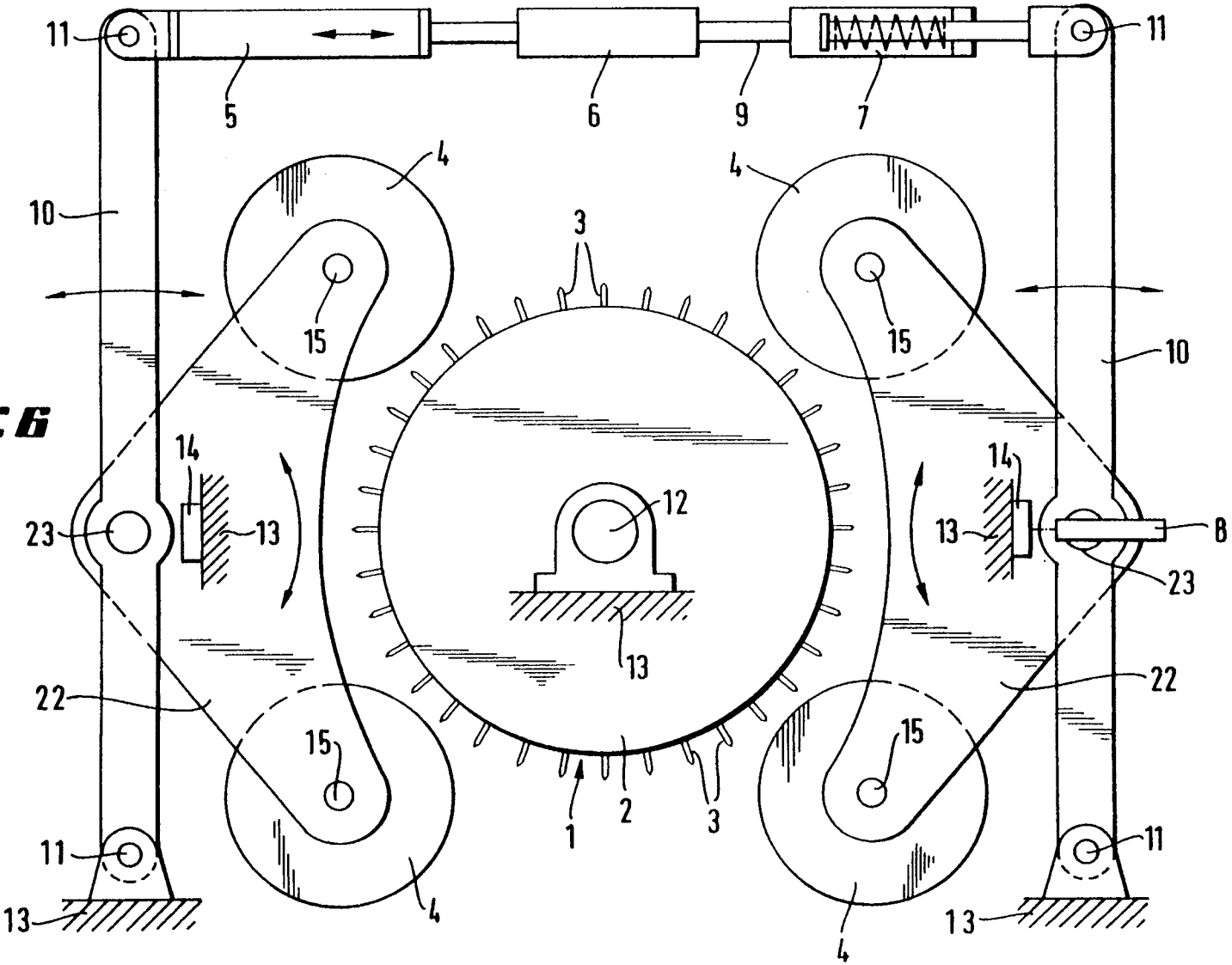
Figure 7:
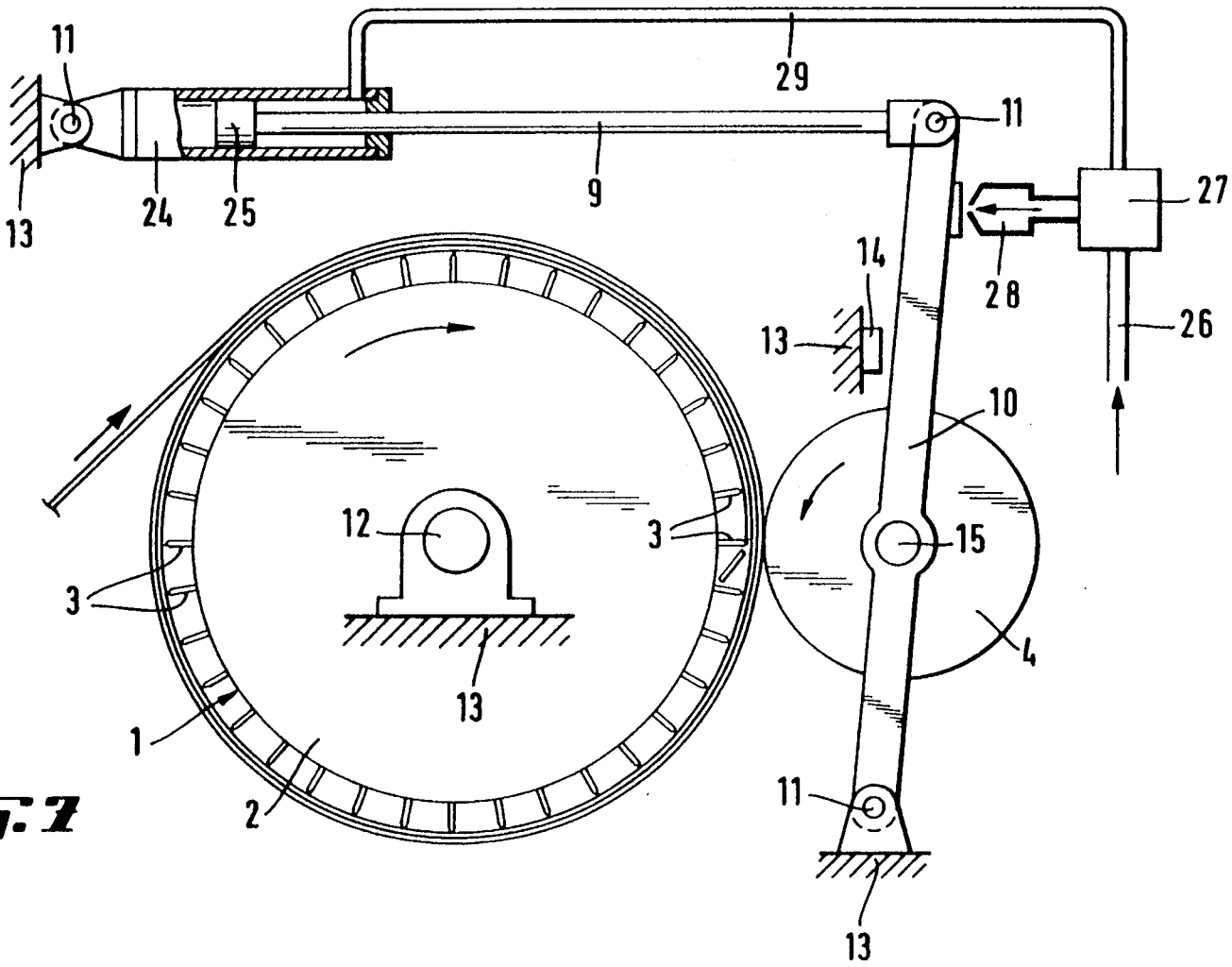

FIGS. 3 and 4 each show an embodiment of the apparatus according to the invention, provided with two pressure rollers, in plan view;

FIG. 5 shows a preferred embodiment of the apparatus according to the invention, provided with two pressure rollers, in plan view, in which the distance between the cutting wheel and the pressure rollers can be kept constant with the aid of a controlled system;

FIG. 6 shows another preferred embodiment of the apparatus according to the invention, provided with four pressure rollers, in plan view;

FIG. 7 also shows a preferred embodiment of the apparatus according to the invention, in which the opening and closing device, the adjusting means and the damping means are formed in one device.

Figure 1:
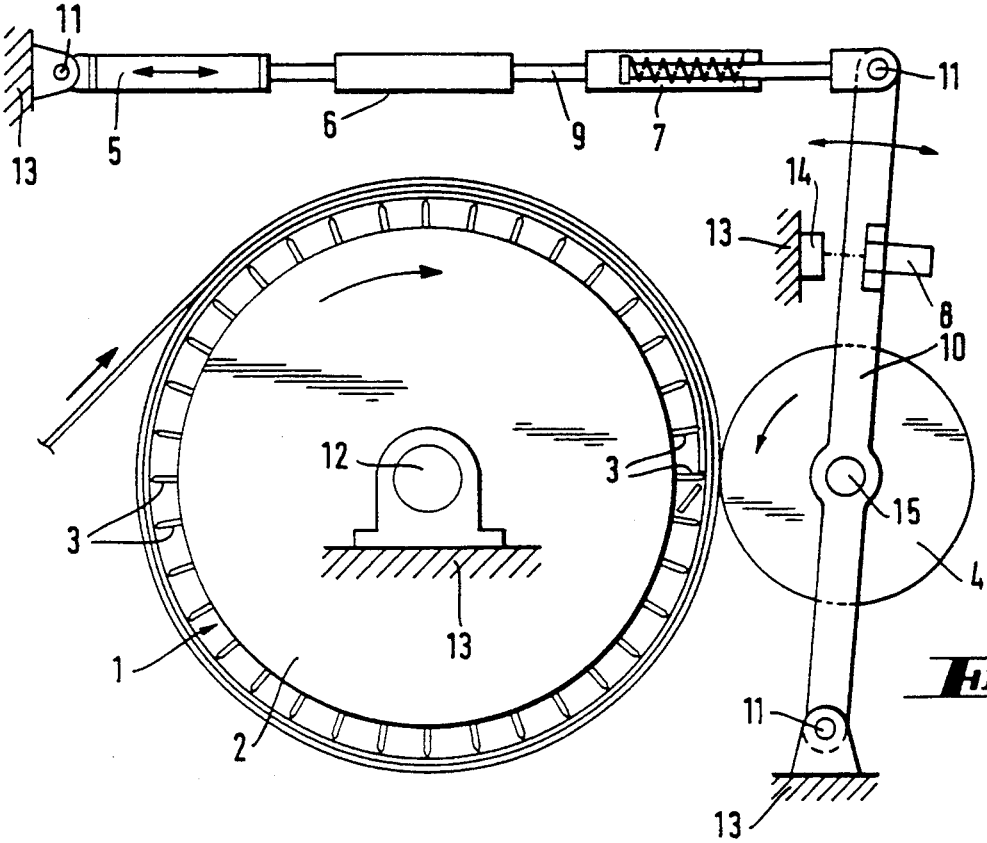
FIG. 1 shows an embodiment of the apparatus according to the invention, provided with one pressure roller, in plan view.

The apparatus shown in FIG. 1 contains a cutting wheel (1) composed of two knife support disks (2) (here shown only in sketch form) disposed axially one above the other with spacing approximately equal to a knife length, between which disks a multiplicity of knives (3) directed radially outwards with spacing corresponding to the desired staple are mounted. The cutting wheel (1) is connected by means of the axle (12) to the casing (13). The fiber tow to be cut up is wound spirally onto the cutting wheel (1). While the innermost layer lies directly on the cutting edges of the knives (3), the outermost layer is first subjected to pressure by the pressure roller (4), which is mounted in a fixed position relative to the rotating cutting wheel (1), at a substantially constant distance from the axle of the cutting wheel. Through the tow wound onto the cutting wheel under tension, each of the individual knives disposed beneath it is acted on, in the region of the pressure roller (4), by a cutting pressure which is directed radially inwards and cuts up the fibers of the innermost layer on the cutting edges of the knives. The staples produced are pushed further radially inwards into the cutting wheel (1) by the following fibers, and then carried off vertically downwards.

The pressure roller (4) is held by the lever arm (10), which is fastened by a joint (11) to the casing (13) and joined to the axle (15) of the pressure roller (4). Said lever arm (10) is in turn pivotally connected to a rod (9) by which the opening and closing device (5), the adjusting means (6) and the damping means (7) act on the lever arm (10). At its other end the rod (9) is pivotally connected to the casing (13). In this embodiment the lever arm (10) also contains a distance measuring device (8), by which the distance between the pressure roller (4) and the cutting wheel (1) can be monitored. In the apparatus illustrated this is done by indirect measurement of the distance between the distance measuring device (8) and the stop (14), which in turn is fastened on the casing (13). The stop (14) serves to prevent direct contact between the pressure roller (4) and the cutting edges of the cutting knives (3). The length of the rod (9) can be varied by means of the opening and closing device (5), the adjusting means (6) and the damping means (7). At the same time, the opening and closing device (5) serves to move the pressure roller (4) away from the cutting wheel (1), for example in order to be able to make a knife change in the event of interruption of the operation. The adjusting means (6) and the damping means (7) serve in particular to maintain the most constant operating conditions possible during the cutting process.

At the beginning of the cutting operation a determined length of the rod (9), and thus a preset distance between the pressure roller (4) and the cutting wheel (1) (for example the outer edge of the knife lying closest to the pressure roller) can be adjusted with the aid of the adjusting means (6). The adjusting means may be composed of a mechanically, pneumatically, hydraulically or electromechanically operated device, for example a screw connection, by which the length of the rod (9) can be varied.

With a preset distance between the pressure roller (4) and the cutting wheel (1) in dependence on the length of the rod (9), the pressure applied by the pressure roller (4) to the tow wound onto the cutting wheel is regulated with the aid of the damping means (7). The damping means (7) is therefore characterized by a load-extension characteristic. It may for example be composed of a spring or a spring assembly, or else may be any other device with the aid of which a load-extension characteristic corresponding to a spring can be preset, for example a computer control system by which a desired load-extension characteristic can be adjusted.

The distance measuring device (8) may for example be composed of a line marking which is provided on the rod (9) and the position of which is compared with a fixed point on the casing (13), so that the variation of the length of the rod (9) can be deduced. However, it may also comprise any other device with the aid of which the variation of the length of the rod (9) and thus the distance between the pressure roller (4) and the cutting wheel (1) can be checked.

At the beginning of the cutting operation a normal adjustment is made with the aid of the adjusting device (6), in the form of a determined length of the rod (9), so that a determined distance between the pressure roller (4) and the cutting wheel (1) is preset and the damping means (7) is prestressed. This distance is checked by means of the distance measuring device (8). Preliminary tests will enable the specialist to determine what distance should be adjusted between the pressure roller (4) and the cutting wheel (1) in the individual case. This distance will depend, among other factors, on the material to be cut up, the quality of the knives at the commencement of the cutting operation, and the pattern of the load-extension characteristic of the damping means (7). When the desired distance has been adjusted, the apparatus is put into operation, so that the material to be cut up is wound onto the knife basket. As soon as a sufficient contact pressure has built up on the outer layers of the package through the action of the pressure roller (4), the cutting operation starts. Through the continuous operation of the apparatus, the cutting edges of the knives wear down. The thickness of the package consequently increases, and with it the distance between the pressure roller (4) and the cutting wheel (1). The length of the rod (9) thus also increases. This is possible only by means of a variation of the length of the damping means (7), whereby the force exerted by the rod (9) on the lever arm (10) is increased, so that the contact pressure exerted by the pressure roller (4) is also increased.

The variation of the length of the rod (9) is indicated by the distance measuring device (8) and is cancelled by operation of the adjusting means (6). The force exerted by the damping means (7) on the lever arm (10) via the rod (9) is thereby increased again, and with it also the contact pressure exerted by the pressure roller (4). A new, steady operating state has now been achieved, which is characterized by a contact pressure increased in comparison with the starting conditions and practically the same distance between the pressure roller (4) and the cutting wheel (1). Because of the increased contact pressure, the decreasing cutting speed of the knives, which wear during operation, is compensated. The adaptation process described can be carried out a number of times during operation and in particular can be controlled without transition, while the cutting speed of the apparatus can be kept practically unchanged within a prescribed range of contact pressures. The service life of the knives can thus be considerably lengthened.

With the apparatus according to the invention, however, not only can advantages be obtained in the normal cutting operation, but on the occurrence of flaws in the material to be cut up the operation can also generally proceed with less risk. Flaws, such as thickenings or knots, may lead to knife breakages in conventional cutting apparatuses, since in the region of such flaws high contact pressures are usually applied to the knives. On the other hand, when in the apparatus according to the invention a fault of this kind in the material being wound onto the cutting apparatus passes through the narrow gap between the pressure roller (4) and the cutting apparatus, the length of the rod (9) is immediately increased and at the same time the contact pressure is increased because of the lengthening of the damping means (7). This increase of the contact pressure is however not as great as in customary cutting apparatuses, which do not permit a brief variation of the distance between the pressure roller (4) and the cutting wheel (1). The risk of knife breakage can thus be reduced with the apparatus according to the invention. In addition, the variation of the contact pressure with the changing length of the rod (9) is adjustable within wide limits through the choice of the steepness of the load-extension characteristic of the damping means (7), so that in this way also the risk of knife breakage can be reduced.

Figure 2:
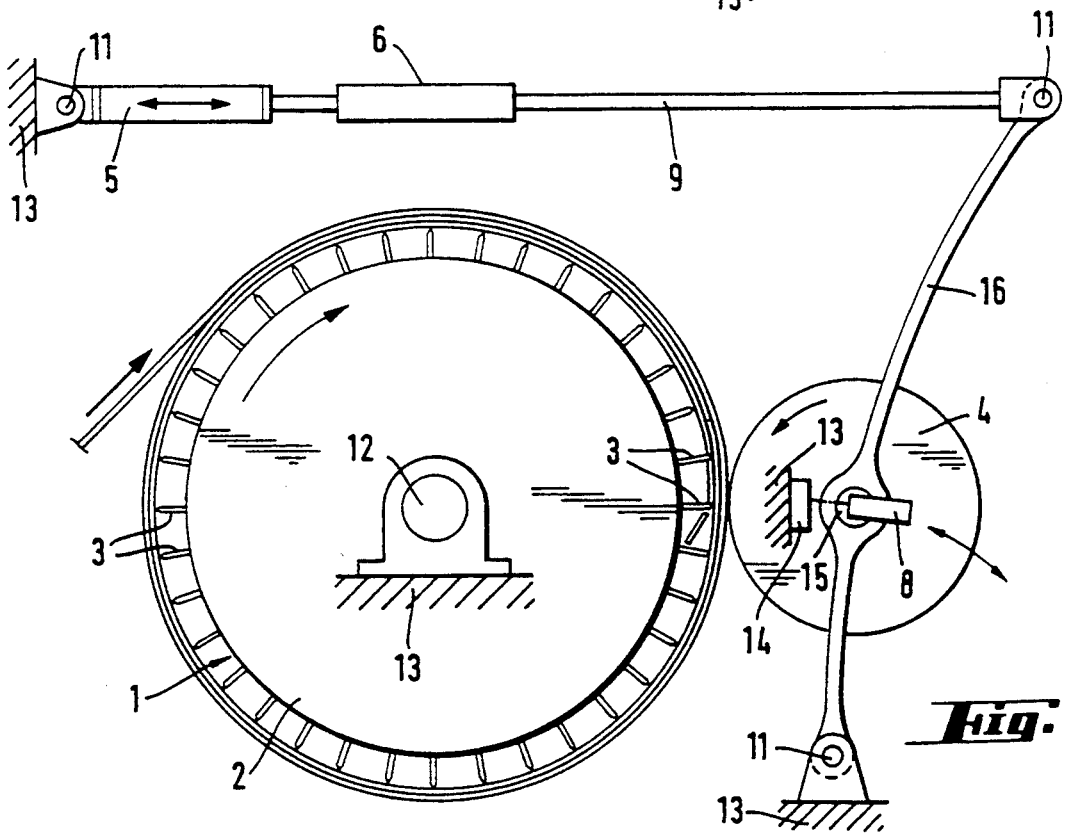
FIG. 2 shows another embodiment of the apparatus according to the invention, in which the damping means has a special configuration, in plan view.

The apparatus according to FIG. 2 is of similar construction to that shown in FIG. 1. Here again the cutting wheel (1), the pressure roller (4), the opening and closing device (5), the adjusting means (6), the distance measuring device (8) and the rod (9) are provided, while instead of the lever arm (10) in FIG. 1 a lever arm (16) is provided in the present case. The rod (9) and the lever arm (16) are connected to the casing 13 and also to one another in the same way as in the apparatus shown in FIG. 1. As a modification of the apparatus according to FIG. 1, however, the damping means (7) is here not installed in the rod (9), but the lever arm (16) acts at the same time as the damping means (7). This can, for example, be achieved by giving the lever arm (16) the form of a resilient member, for example of a leaf spring. In other respects the mode of operation and working is exactly the same as in the apparatus according to FIG. 1.

The apparatus shown in FIG. 3 is a preferred embodiment having two pressure rollers (4). The construction corresponds substantially to that of the apparatus according to FIG. 1. A cutting wheel (1), two pressure rollers (4), an opening and closing device (5), an adjusting means (6), a damping means (7), a distance measuring device (8), a rod (9), two lever arms (10) and two stops (14) are provided. The lever arms (10) are each pivotally fastened at one end to the casing (13). At the opposite end in each case the lever arms (10) are pivotally connected to the rod (9), so that a double-armed rocker is formed. The distance measurement is made in the apparatus illustrated by measuring the distance between the distance measuring device (8) and a marker (18) provided on a bar (18*a*). The bar (18*a*) is pivotally fastened to one lever arm (10) and at one end is mounted so as to be freely movable between the two lever arms (10). In the embodiment illustrated it rests near its other end on a stop (17) on the second lever arm (10), so that when the distance between the two lever arms (10) varies it is freely movable at one end.

A particular advantage of this construction is to be seen in the fact that, when flaws in the material to be cut up pass through the narrow gap between a pressure roller and the cutting apparatus, the sudden deflection of this pressure roller is partly compensated by a movement of the second pressure roller in the opposite direction. The risk of a knife breakage is thereby further reduced.

The apparatus shown in FIG. 4 corresponds substantially to the apparatus shown in FIG. 3. Here the lever arms (10) are simply fastened centrally to the casing (13) in each case and the pressure rollers (4) are each mounted at the end of a lever arm (10).

A very particularly preferred embodiment of the cutting apparatus according to the invention is shown in FIG. 5. This is in principle the construction provided with two pressure rollers (4) which is illustrated in FIG. 3. A cutting wheel (1), two pressure rollers (4), an opening and closing device (5), an adjusting means (6), a damping means (7), a distance measuring device (8), a rod (9) and two lever arms (10) are provided. The distance measuring device (8) in this embodiment is mounted on the casing (13) and reacts on the adjusting means (6) via a controlled system (21) and a servomotor (20). With the aid of this arrangement the position of one end of the rod (9) is practically always kept constant during the operation of the apparatus. Moreover, in this embodiment of the apparatus a tension or pressure sensor (19) is provided, with the aid of which contact pressure between the pressure roller (4) and the cutting wheel (1) can be measured directly. In the present case this pressure sensor is mounted directly on the damping means (7). However, it may also be mounted in any other position on the rod (9). The tension or pressure sensor (19) is advantageously coupled to a contact-breaking device (not shown), by which the apparatus is automatically switched off when a predetermined limit value of the contact pressure is reached (in steady state operation or when a flaw passes through). In addition, in FIG. 5 two stops (14) are also shown, which are intended to prevent the distance between the pressure rollers (4) and the cutting wheel (1) from falling below a minimum distance. Instead of the tension or pressure sensor (19), the automatic disconnection can also be effected by a limit switch operated by the damping means (7).

FIG. 6 shows another preferred embodiment of the cutting apparatus according to the invention. In principle this is a construction of the type shown in FIG. 3. In this variant, however, four pressure rollers (4) are provided, which are coupled together in pairs. In the apparatus shown in FIG. 6, a cutting wheel (1), four pressure rollers (4), an opening and closing device (5), an adjusting means (6), a damping means (7), a distance measuring device (8), a rod (9) and two lever arms (10) are provided. The distance measuring device (8) in this embodiment is mounted on one of the lever arms (10) and measures the distance between its position and a stop (14). Each pair of pressure rollers (4) is pivotally connected via a mount (22) to a lever arm (10). The connection is made by means of the pin (23). This embodiment is a further improvement on the construction in FIG. 3, as the additional cutting power suddenly becoming necessary when flaws in the material to be cut up pass through the narrow gap between a pressure roller and the cutting apparatus is distributed over a plurality of pressure rollers. The risk of a knife breakage is thus reduced still further. In addition, the service life of the cutting knives is thereby also lengthened, since the cutting pressure can be reduced for a given cutting power because a cutting pressure exerted on the material to be cut up is exerted at four points for every revolution.

FIG. 7 illustrates an embodiment of the apparatus according to the invention in which the opening and closing device (5), the adjusting means (6) and the damping means (7) are combined in one component. An embodiment having only one pressure roller (4) is illustrated, but the embodiments having two or more pressure rollers (4) can of course also be of this design.

In the apparatus shown in FIG. 7 a cutting wheel (1), a pressure roller (4), a rod (9) and a lever arm (10) are provided. The rod (9) and the lever arm (10) are pivotally connected to one another and each is pivotally connected to the casing (13). A stop (14) prevents the pressure roller (4) from striking against the cutting edges of the cutting knives (not shown here). The rod (9) contains a pneumatic cylinder (24), the body of which forms one part of the rod (9), while its piston (25) is joined to the other part of the rod (9). One compartment of the interior space divided by the piston (25) in the pneumatic cylinder (24) is in communication with a line (29) which acts as a controlled system and is in communication with a supply line (26) via a pneumatic control unit (27) provided with a nozzle (28), the outlet opening of which is directed towards the lever (10).

The nozzle (28) and the pneumatic control unit (27) and pneumatic cylinder (24) operate together as the opening and closing device (5), the adjusting means (6), the damping means (7) and the distance measuring device (8). During continuous cutting operation a preselected distance is adjusted between the pressure roller (4) and the cutting wheel (1). By means of a gas, for example air, passing through the supply line (26) a determined pressure is preset in the pneumatic control unit (27) for the pneumatic cylinder (24) and, depending on the distance between the nozzle (28) and the lever arm (10), a part of the gas can escape through the nozzle (28). A state of equilibrium is established which is characterized by a determined position of the piston (25) in the body of the pneumatic cylinder. If, as the result of wear on the cutting knives or because of the arrival of a thickening of the material between the cutting knives and the pressure roller (4), the lever arm (10) is then deflected, the escape of the gas through the nozzle (28) becomes difficult at any such moment, because the lever arm (10) moves closer to the nozzle opening and pressure thus builds up in the line (29). The pressure in one compartment of the pneumatic cylinder (24) is thus raised. This has the immediate consequence that the piston will move in the direction of the compartment in which the pressure is lower, so that the lever arm (10) is moved away from the opening of the nozzle (28) through the action of the rod (9) and thus the gas can flow out more easily. In this way a new, steady state is established; in the event of further variations of the pressure conditions between the pressure roller (4) and the cutting wheel (1), this state will be changed again in the manner described. The pneumatic cylinder (24) can in addition be operated as an opening and closing device (5) if the pressure roller (4) should move away from the cutting wheel (1), for example after interruption of the cutting operation. The load-displacement characteristic of the cutting device can be appropriately adjusted by the design of the pneumatic cylinder (24).

With the apparatus according to the invention and with the method according to the invention practically any material in sliver or strand form can be continuously cut up into staple in a simple manner, such as fibers of natural polymers, inorganic substances and synthetic polymers. The invention is preferably applicable to the cutting-up of man-made fiber tows, particularly the cutting-up of fiber tows of polyester, polyamide, polyacrylonitrile or viscose. The cut material is distinguished by great uniformity of the individual staple fibers and by uniform quality of the cut ends, which quality does not substantially vary even over a long period of operation.

A preferred field of application of the apparatus according to the invention relates to the production of short cut fibers. These are usually fibers of a staple length of about 2.5 to 8 millimeters, particularly 4 to 6 millimeters.

With the apparatus according to the invention it is possible to produce short cut fibers over a long period of time and with practically uniform quality.

Particularly in the production of short cut fibers a special design of the cutting wheel and of the knives is advisable.

Thus, the arrangement of the knives in the knife basket is preferably so selected that the passage formed by the individual knife blades is enlarged in the direction of transport of the cut staple fibers. The transport of the cut staple fibers along the knives is facilitated in this way.

In addition, a determined ratio of the width of the cutting knives to the thickness of the fiber tow to be cut up should be selected. Care must be taken that the material to be cut does not exceed a determined thickness on the cutting wheel.

Cutting knives having asymmetrically disposed cutting edges are preferably used for the production of short cut fibers. These may be knives whose cutting edge, viewed from the shorter side of a knife blade, is situated directly at the left-hand or right-hand top edge of the knife; however, they may also be knives in which the cutting edge, viewed from the shorter side of a knife blade, is situated between the center and the left- or right-hand top edge of the knife but not at the center between the two edges. By the use of knives having asymmetrically disposed cutting edges (knives ground on one side or asymmetrically), different forces act during the cutting-up, at right angles to the axial direction, on the two ends of the staple fiber, so that the cut staple fibers assume an oblique position during their onward transport between the knife blades and less force is required for their onward transport.

Another preferred measure in the production of short cut fibers is the selection of the shortest possible distance between the cutting wheel and the pressure roller. A distance of about 0.5 to 2 millimeters is preferably selected.

In the production of short cut fibers it is also possible to use a cutting preparation, provided that the latter does not impair the desired properties of the product. Use is made in particular of a preparation improving the sliding properties of the fibers. The use of the driest possible fiber tows also usually facilitates the cutting operation.

I claim:

1. An apparatus for continuously cutting up wound fiber tow material into staple fibers of a selected length, which comprises:

a) at least one cutting wheel having a multiplicity of cutting knives disposed in a circle in a knife mount and spaced apart at a distance corresponding to the length of the desired staple fiber, b) at least one pressure roller for producing on the wound fiber tow material a cutting pressure acting on the cutting knives, c) an opening and closing device by means of which the pressure roller can be moved a predetermined distance away from said at least one cutting wheel or towards the cutting wheel, d) an adjusting means by which a preset distance can be adjusted between the pressure roller and said at least one cutting wheel, e) a damping means for adjusting the contact pressure exerted by the pressure roller on the fiber tow material contacting the knives of said at least one cutting wheel, and f) a distance measuring device by which the distance between the pressure roller and the cutting knives of said at least one cutting wheel can be monitored.

2. The apparatus as claimed in claim 1, wherein the at least one cutting wheel comprises two knife support disks disposed axially one above the other with spacing approximately equal to a knife length, between which disks a multiplicity of cutting knives directed radially outwards with spacing corresponding to the desired staple are mounted.

3. The apparatus as claimed in claim 2, wherein said at least one pressure roller is disposed outside and spaced apart from said at least one cutting wheel, whereby a cutting force is exerted upon the wound fiber tow material between said pressure roller and cutting wheel.

4. The apparatus as claimed in claim 1, wherein the knives have cutting edges, and the minimum distance between the pressure roller and the cutting edges of the knives is adjustable by means of a stop.

5. The apparatus as claimed in claim 1, wherein the apparatus is mounted upon a support casing; a lever arm is pivotally fastened to the support casing; and the lever arm is pivotally connected to a rod whereby the opening and closing device, the adjusting means and the damping means act on the lever arm.

6. The apparatus as claimed in claim 5, wherein the rod is provided with a monitoring device which switches off the apparatus if a predetermined limit value of the contact pressure is exceeded.

7. The apparatus as claimed in claim 6, which is provided with a tension or pressure sensor mounted on the rod.

8. The apparatus as claimed in claim 7, wherein a control system is connected to a distance measuring device and a servomotor on the adjusting means, and functions during operation of the apparatus to ensure the same distance between the at least one pressure roller and the at least one cutting wheel is maintained throughout the operation of the apparatus.

9. The apparatus as claimed in claim 1, wherein two pressure rollers are provided, each of which is disposed on an opposite side of said at least one cutting wheel from the other pressure roller.

10. The apparatus as claimed in claim 9, wherein four pressure rollers are provided, which are pivotally connected, one pair to each lever arm, by means of respective mounts.

11. The apparatus as claimed in claim 1, wherein the apparatus is mounted upon a support casing which has two lever arms, which lever arms are pivotably fastened to said casing, and which lever arms are further pivotably connected together by a rod having an adjusting means; and two pressure rollers are mounted on on each of said lever arms whereby the opening and closing device, the adjusting means and the damping means act on the lever arm.

12. The apparatus as claimed in claim 1, wherein the damping means is a spring.

13. The apparatus as claimed in claim 12, wherein the spring is a cup spring.

14. The apparatus as claimed in claim 1, wherein the adjusting means comprises a rod having a screw connection by which the length of the rod can be adjusted.

15. The apparatus as claimed in claim 1, wherein the apparatus is formed with a support casing; the opening and closing device, the adjusting means and the damping means are in alignment with one another; and a rod are pivotally connected together; and the lever arm is pivotally connected to the support casing; a stop is provided which prevents the pressure roller from striking against the cutting edges of the cutting knives; the rod contains a pneumatic cylinder forming one part of the rod and a piston connected to one end of the rod; one interior compartment of said cylinder, divided off by the piston, being connected to a line which acts via a pneumatic control unit.

16. The apparatus as claimed in claim 1, wherein the arrangement of the cutting knives in the cutting wheel forms a passage for the cut staple fibers.

17. The apparatus as claimed in claim 1, wherein the cutting knives comprise cutting knives having asymmetrically disposed cutting edges.

* * * * *